US009725200B2

(12) United States Patent
Krämer

(10) Patent No.: US 9,725,200 B2
(45) Date of Patent: Aug. 8, 2017

(54) BEVERAGE BOTTLING PLANT WITH HEATED INFORMATION-ADDING EQUIPMENT AND INFORMATION-ADDING EQUIPMENT

(75) Inventor: Klaus Krämer, Dortmund (DE)

(73) Assignee: KHS GmbH, Dortmund (DE)

( * ) Notice: Subject to any disclaimer, the term of this patent is extended or adjusted under 35 U.S.C. 154(b) by 723 days.

(21) Appl. No.: 12/778,716

(22) Filed: May 12, 2010

(65) Prior Publication Data

US 2010/0282363 A1 Nov. 11, 2010

Related U.S. Application Data

(63) Continuation-in-part of application No. PCT/EP2008/009427, filed on Nov. 7, 2008.

(30) Foreign Application Priority Data

Nov. 12, 2007 (DE) ..... 10 2007 054 147

(51) Int. Cl.
*B65C 9/22* (2006.01)
*B65C 9/00* (2006.01)

(52) U.S. Cl.
CPC ..... *B65C 9/22* (2013.01); *B65C 9/2291* (2013.01); *B65C 2009/0075* (2013.01)

(58) Field of Classification Search
CPC ..... B42C 9/0012; B05C 1/003; B05C 1/0873
USPC ..... 53/136.1; 156/583.1, 359; 118/244, 258
See application file for complete search history.

(56) References Cited

U.S. PATENT DOCUMENTS 3,719,542 A * 3/1973 Schmitz et al. ..... 156/502
3,754,456 A * 8/1973 Andrews et al. ..... 493/274
3,790,736 A 2/1974 Matsumura et al.
3,911,642 A * 10/1975 Ernstsson et al. ..... 53/426
4,013,496 A * 3/1977 Amberg ..... 156/85
4,207,832 A * 6/1980 Bowman et al. ..... 118/212
4,347,095 A * 8/1982 Yamashita ..... B65C 9/2269 118/221

(Continued)

FOREIGN PATENT DOCUMENTS

DE 37 41 232 6/1989
DE WO 94/22593 * 10/1994 ..... B42C 9/0012

(Continued)

OTHER PUBLICATIONS

International Search Report PCT/EP2008/009427 and English translation thereof.
German Office Action 10 2007 054 147.5-27.

*Primary Examiner* — Gloria R Weeks
(74) *Attorney, Agent, or Firm* — Nils H. Ljungman & Associates

(57) ABSTRACT

A gluing arrangement for applying glue to labels in a labeling machine, which gluing arrangement has a heated roller element and one or more temperature sensors which sense the temperature of a portion of the roller element. The temperature sensors are protectively sealed against contamination and mechanical damage, such as by being sealed inside the body of the roller element. The gluing arrangement also has a heating arrangement which includes one or more induction coils for heating the roller element. The heating arrangement and/or induction coils are positioned within the roller element such that they are surrounded by either an inner or outer surface of the roller element.

13 Claims, 3 Drawing Sheets

(56) References Cited

U.S. PATENT DOCUMENTS 4,519,310 A * 5/1985 Shimizu et al. ..... 101/35
4,530,063 A * 7/1985 Masuda et al. ..... 358/1.12
4,530,663 A * 7/1985 Portnoy ..... 433/189
4,556,779 A * 12/1985 Hashimoto et al. ..... 219/216
4,570,044 A * 2/1986 Kobayashi et al. ..... 219/619
4,673,303 A * 6/1987 Sansone et al. ..... 347/103
4,740,671 A * 4/1988 Kuroda et al. ..... 219/492
4,743,920 A * 5/1988 Tohma et al. ..... 347/171
4,761,200 A * 8/1988 Szeremeta ..... B65C 9/1819 118/231
4,833,299 A * 5/1989 Estes ..... 392/444
4,909,888 A * 3/1990 Kobayashi et al. ..... 156/361
4,999,666 A * 3/1991 Kuwabara et al. ..... 355/401
5,160,570 A * 11/1992 Dickey ..... 156/448
5,275,678 A * 1/1994 West ..... B65C 3/16 156/215
5,278,394 A * 1/1994 Morino ..... 219/497
5,311,816 A * 5/1994 Schliessmann ..... 101/488
5,362,945 A 11/1994 Baader
5,434,387 A * 7/1995 Haley ..... B29B 13/024 156/296
5,466,326 A * 11/1995 Cherney ..... 156/359
5,517,293 A * 5/1996 Tonai et al. ..... 399/331
5,538,575 A * 7/1996 Hinton ..... B65C 9/1819 118/259
5,547,293 A * 8/1996 Koch et al. ..... 400/120.17
5,605,575 A * 2/1997 Anderson ..... B05C 1/003 118/101
5,666,627 A * 9/1997 Yamaguchi ..... 399/330
5,679,209 A * 10/1997 Hinton ..... B65C 9/02 156/448
5,682,577 A * 10/1997 Kiyoi ..... 399/69
5,832,354 A * 11/1998 Kouno et al. ..... 399/330
5,846,358 A * 12/1998 Nagamoto et al. ..... 156/64
5,876,514 A * 3/1999 Rolando et al. ..... 134/25.2
5,880,089 A * 3/1999 Lentsch et al. ..... 510/514
5,882,469 A * 3/1999 Detterman ..... B05C 1/003 118/224
5,964,974 A * 10/1999 Hinton ..... 156/215
6,066,223 A * 5/2000 Gomes et al. ..... 156/215
6,093,279 A * 7/2000 Detterman et al. ..... 156/295
6,255,632 B1 7/2001 Yokoyama et al.
6,276,266 B1 * 8/2001 Dietz et al. ..... 101/41
6,283,022 B1 * 9/2001 Kamen et al. ..... 101/129
6,289,198 B1 * 9/2001 Kawamura et al. ..... 399/333
6,298,215 B1 * 10/2001 Nomura et al. ..... 399/328
6,401,787 B1 * 6/2002 Tsutsumi et al. ..... 156/542
6,444,084 B1 * 9/2002 Collins ..... 156/345.1
6,558,059 B1 5/2003 Hillinger
6,623,596 B1 * 9/2003 Collins et al. ..... 156/345.48
6,670,588 B2 * 12/2003 Kitano et al. ..... 219/619
6,673,152 B2 * 1/2004 Guzzon et al. ..... 118/315
6,857,358 B2 * 2/2005 Dittrich et al. ..... 101/35
6,877,917 B2 * 4/2005 Hoshino et al. ..... 400/120.01
6,880,457 B2 * 4/2005 Roesch et al. ..... 101/38.1
6,964,707 B2 * 11/2005 Taniguchi et al. ..... 118/244
6,997,108 B2 * 2/2006 Tabuchi et al. ..... 101/217
7,013,624 B2 * 3/2006 Zwilling ..... 53/544
7,032,514 B2 * 4/2006 Mori et al. ..... 101/463.1
7,135,660 B2 * 11/2006 Miyahara et al. ..... 219/619
7,146,127 B2 * 12/2006 Takagi et al. ..... 399/330
7,213,383 B2 * 5/2007 Walker et al. ..... 53/329.2
7,308,780 B2 * 12/2007 Rimondi ..... 53/373.8
7,466,740 B2 * 12/2008 Lazor ..... 373/144
7,875,143 B2 * 1/2011 Kontz ..... 156/215
8,109,311 B2 * 2/2012 Tsuchiya ..... 156/359
2002/0020698 A1 2/2002 Okamoto et al.
2002/0058601 A1 * 5/2002 Jordan, IV ..... A01N 25/30 510/421
2002/0092618 A1 * 7/2002 Collins ..... 156/345.48
2004/0005176 A1 * 1/2004 Yokozeki et al. ..... 399/328
2004/0157051 A1 * 8/2004 Trent ..... A47J 47/005 428/327
2004/0175407 A1 * 9/2004 McDaniel ..... A62D 3/02 424/423
2006/0276317 A1 12/2006 Pietikainen
2007/0193511 A1 * 8/2007 Sasamoto ..... B42C 11/02 118/666
2009/0194450 A1 * 8/2009 Dabadie ..... C09D 123/0815 206/484
2011/0146914 A1 * 6/2011 Kontz ..... 156/381
2012/0093531 A1 * 4/2012 Yuasa ..... G03G 15/2032 399/67
2012/0116723 A1 * 5/2012 Shaw ..... H01R 39/08 702/188
2014/0116597 A1 * 5/2014 Miller ..... B29C 63/0065 156/60

FOREIGN PATENT DOCUMENTS

DE 298 22 906 U1 2/2000
DE 202 17 966 U1 4/2004
EP 1 168 889 A2 1/2002
EP 1 416 772 A 5/2004
JP 2002-170659 A 6/2002
JP 2004-094076 A 3/2004

* cited by examiner

BEVERAGE BOTTLING PLANT WITH HEATED INFORMATION-ADDING EQUIPMENT AND INFORMATION-ADDING EQUIPMENT

CONTINUING APPLICATION DATA

This application is a Continuation-In-Part application of International Patent Application No. PCT/EP2008/009427, filed on Nov. 7, 2008, which claims priority from Federal Republic of Germany Patent Application No. 10 2007 054 147.5, filed on Nov. 12, 2007. International Patent Application No. PCT/EP2008/009427 was pending as of the filing date of this application. The United States was an elected state in International Patent Application No. PCT/EP2008/009427.

BACKGROUND

1. Technical Field

The present application relates to a beverage bottling plant with heated information-adding equipment and information-adding equipment.

2. Background Information

Background information is for informational purposes only and does not necessarily admit that subsequently mentioned information and publications are prior art.

Labeling assemblies for use in labeling machines may have various designs. Sometimes gluing rollers are used for a direct or indirect application of the desired gluing film onto the labels. Depending on the type of glue used, it is often desired not only to heat the glue supply to the respective gluing roller, but rather also to heat the gluing roller itself.

Some glue-application devices for labeling machines comprise a gluing roller, the roller element of which, being driven to rotate, can be inductively heated by an electrical heating device on its circumferential or gluing surface. In such devices, the heating device is stationary, i.e. is not arranged to rotate with the roller element. Heating of the roller element is carried out inductively. In such devices, the heating device and also the temperature sensors for controlling the heating output are in each case located outside the gluing roller or the roller element which is driven to rotate and in the immediate, substantially immediate, or essentially immediate vicinity of the outer surface or gluing surface of the roller element. Therefore, the heating device and temperature sensors for controlling the heating output are in a region in which these components are exposed to heavy contamination usually as a result of glue. These components may also be exposed to the risk of mechanical damage as a result of the external action of forces. In the case of such glue-application devices, the heating device furthermore extends across the entire axial height of the rotating roller element of the gluing roller so that individual temperature control or regulation of individual regions following one another or adjoining one another in the direction of the axis of the roller element is not possible. It is moreover a limitation in the case of such a glue-application device that, as a result of the heating device arranged in a stationary manner on the periphery of the roller element, the partial region of the roller element, which is located in each case directly on this heating device, is temporarily heated. Therefore, in each case a full rotation of the roller element is desired for a heating of the roller element on the entire circumferential or gluing surface. The result of this is that a relatively long preheating time is desired in the case of a roller element which is driven to rotate, usually when starting up a labeling machine.

Some inductively heatable rollers may have at least one induction coil arranged within the roller body as a heating element. Some such rollers are, however, not gluing rollers, but rather rollers for heating rope or fibrous material guided via the respective roller, heatable rollers of a printing device, heatable calender rollers, or heatable rollers for the production of widths composed of fibrous material.

The present application relates to a labeling assembly for labeling machines comprising at least one electrically heatable gluing roller. The labeling assembly also comprises a roller element that can be driven to rotate about a gluing roller axis. The roller element forms at least one circumferential or gluing surface. The gluing surface surrounds the gluing roller axis. The gluing surface is configured rotation-symmetrically to the gluing roller axis for the application of glue to be transferred at least partially to labels. The labeling assembly also comprises a heating device comprising at least one induction coil for heating the roller element. The heating device comprises at least one induction coil heats the roller element at least on the glue surface by currents induced in the roller element. The labeling assembly also comprises at least one temperature sensor for recording the temperature of the roller element on at least one region of the at least one glue surface. The at least one heating device is completely, virtually completely, or substantially completely disposed in a space that is located inside the gluing surface, or the imaginary extension thereof in the direction of the gluing roller axis. The at least one temperature sensor on the roller element is disposed, in at least one possible embodiment of the present application, in a manner which protects against contamination and/or mechanical damage. The present application also relates to, in at least one possible embodiment, a labeling assembly comprising an electrically heatable gluing roller.

OBJECT OR OBJECTS

An object of the present application is to indicate a labeling assembly which minimizes the limitations mentioned above and enables short heating-up times of the gluing roller while accommodating the heating device of this gluing roller in a manner which protects against contamination and mechanical damage.

SUMMARY

The present application seeks to achieve this object with a labeling assembly for labeling machines comprising at least one electrically heatable gluing roller. The labeling assembly also comprises a roller element that can be driven to rotate about a gluing roller axis. The roller element forms at least one circumferential or gluing surface. The gluing surface surrounds the gluing roller axis. The gluing surface is configured rotation-symmetrically to the gluing roller axis for the application of glue to be transferred at least partially to labels. The labeling assembly also comprises a heating device comprising at least one induction coil for heating the roller element. The heating device comprising at least one induction coil heats the roller element at least on the glue surface by currents induced in the roller element. The labeling assembly also comprises at least one temperature sensor for recording the temperature of the roller element on at least one region of the at least one glue surface. The at least one heating device is completely, virtually completely, or substantially completely disposed in a space that is located inside the gluing surface, or the imaginary extension thereof in the direction of the gluing roller axis. The at least one temperature sensor on the roller element is disposed, in at least one possible embodiment of the present application, in a manner which protects against or minimizes or restricts contamination and/or mechanical damage. The present application also relates to, in at least one possible embodiment, a labeling assembly comprising an electrically heatable gluing roller.

Further developments, uses and potential applications of the present application will become apparent from the following description of possible embodiments and from the figures. In this case, the described and/or pictorially represented features themselves or in any combination are fundamentally the subject matter of the present application.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application is explained in greater detail below with reference to the figures on the basis of a possible embodiment.

DESCRIPTION OF EMBODIMENT OR EMBODIMENTS

In the figures, 1 is a labeling machine for labeling bottles 2 which are moved past a labeling assembly 4 on a rotor 3 which is driven to rotate about a vertical machine axis.

Figure 1:
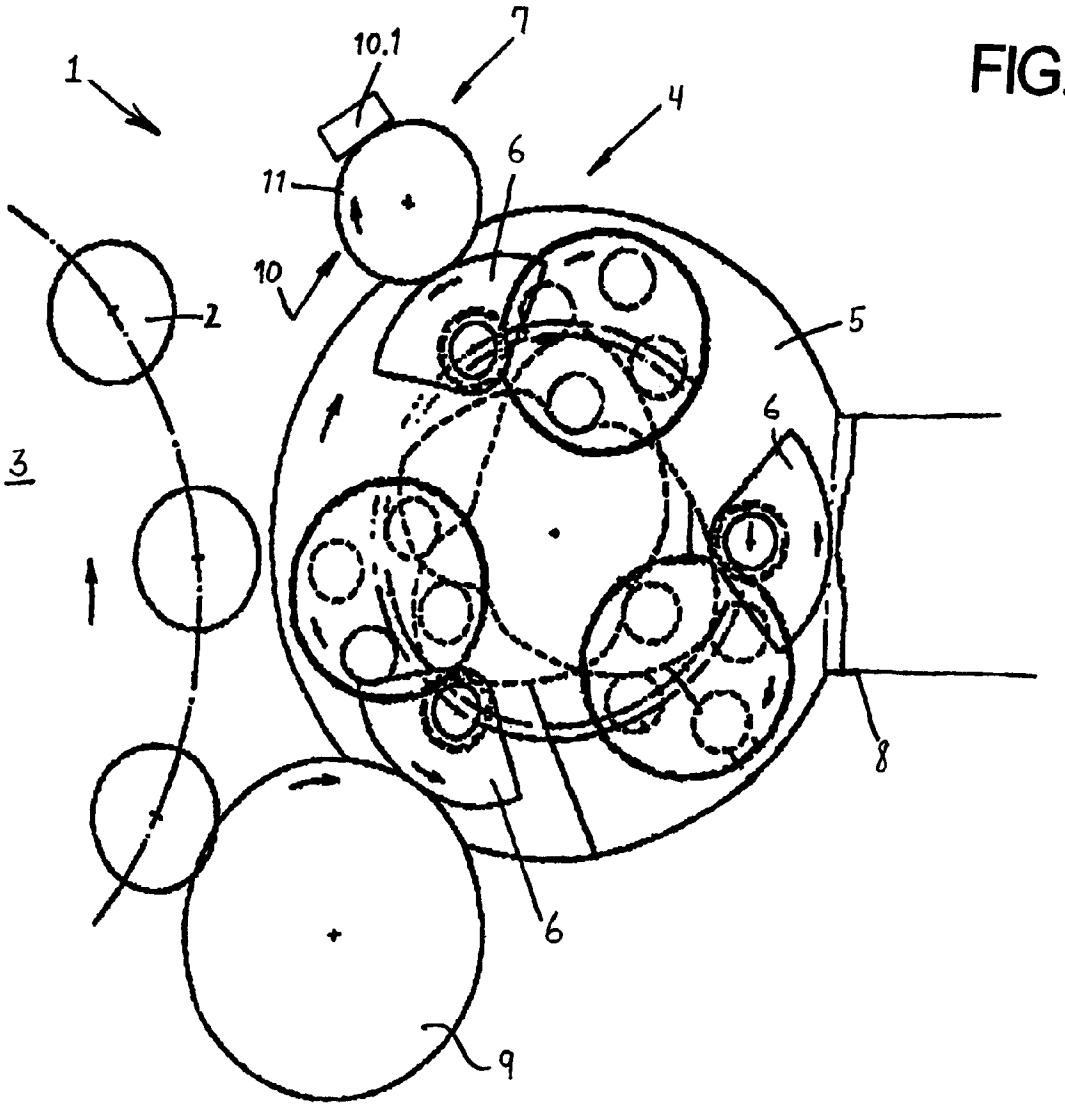
FIG. 1 shows, in a simplified representation and in a top view, the labeling assembly of a labeling machine, together with a heatable gluing roller according to the present application.
Figure 2:
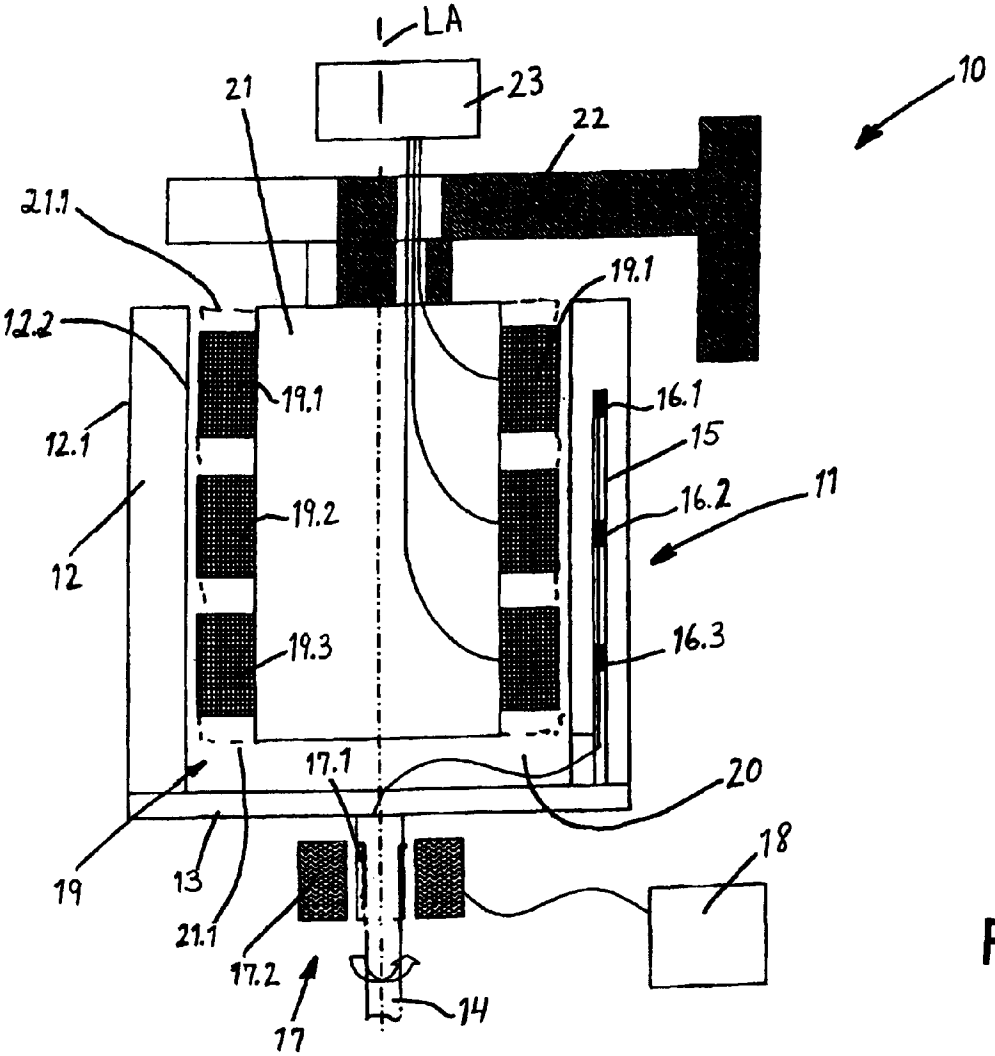
FIG. 2 shows, in a schematic representation and in section, the heatable gluing roller of the labeling assembly of FIG. 1.

FIG. 2 shows the heatable gluing roller 10 in a schematic representation and in section. It substantially comprises a bowl-like roller element 11 which can be driven to rotate about vertical gluing roller axis LA by a drive, not shown, and is formed by an annular segment 12 with a circular cylindrical outer surface 12.1 and circular cylindrical inner surface 12.2 as well as a circular disc-shaped base segment 13 arranged perpendicular, virtually perpendicular, or substantially perpendicular to gluing roller axis LA and connected at one face to the annular segment. Outer surface 12.1 of annular segment 12 is the circular cylindrical circumferential or gluing surface of gluing roller 10, which surface is glued via gluing strip 10.1.

Roller element 11 is fastened with base segment 13 on a shaft 14 arranged on the same axis as gluing roller axis LA, which shaft 14 is rotatably mounted in a manner not shown in greater detail in a machine frame of labeling assembly 4 and is connected to the drive which is also not shown. At least one bore 15 running parallel, virtually parallel, or substantially parallel to gluing roller axis LA for receiving electrical temperature sensors 16.1, 16.2, 16.3 is provided in the wall of annular segment 12, measurement signals of which corresponding to the temperature of annular segment 12 are transmitted via an electrical rotary connection or rotary transmitter 17 individually and, in at least one possible embodiment of the present application, without contact, e.g. capacitively or inductively or in any other suitable manner to measurement and control electronics 18, and namely, among other things, for the temperature-controlled or regulated heating of gluing roller 10 or of roller element 11. Rotary transmitter 17 comprises, for example, a rotor 17.1 provided on shaft 14, which rotor 17 is connected within roller element 11 to the at least one temperature sensor 16.1, 16.2, 16.3 and comprises a stator 17.2 which is connected to the measurement and control electronics 18 in order to pass on the measurement signal.

In one possible embodiment of the present application, the roller element 11 and/or annular segment 12 may be circular. In another possible embodiment of the present application, the roller element roller element 11 and/or annular segment 12 may be elliptical. In another possible embodiment of the present application, the roller element 11 and/or annular segment 12 may comprise circular portions or substantially circular portions. In another possible embodiment of the present application, the roller element 11 and/or annular segment 12 may comprise elliptical portions or substantially elliptical portions. In other embodiments of the present application, the roller element 11 and/or annular segment 12 may comprise other curves or curved shapes, for example, such as crescent shapes or shapes like the outer crust of a slice of pizza.

Heating of the roller element or of annular segment 12 which forms the lateral or gluing surface of gluing roller 10 is carried out inductively by several electrical induction windings or coils 19.1, 19.2, and 19.3 which are accommodated in inner space 20, surrounded by annular segment 12, of roller element 11 and thus, among other things, in a space or volume which is protected as far as possible against contamination, in at least one possible embodiment, by glue, and namely such that circular ring-shaped induction coils 19.1, 19.2, 19.3 which are offset from one another in the direction of gluing roller axis LA and spaced apart from one another are arranged with their coil axes in each case on the same axis as gluing roller axis LA. Induction coils 19.1, 19.2, 19.3 are held on a circular cylindrical lateral surface of a core 21 which reaches into space 20 with the axis of core 21 also on the same axis as gluing roller axis LA from the top through the open face of roller element 11 and is held at its upper end on a bracket or carrier 22 of gluing station 7, and namely not rotating with roller element 11.

In one possible embodiment of the present application, the space 20 may comprise an imaginary cylinder or an imaginary at least partial cylinder. The heating arrangement 19 and/or induction coils 19.1, 19.2, and 19.3 may be disposed inside the imaginary cylinder or imaginary at least partial cylinder. The imaginary cylinder and/or imaginary at least partial cylinder may extend upward and downward in the direction of the roller axis LA. The roller element 11 may comprise a top surface and a bottom surface. A top imaginary plane may extend through the top surface of the roller element 11 in a direction transverse and/or perpendicular to the roller axis LA. A bottom imaginary plane may extend through the bottom surface of the roller element 11 in a direction transverse and/or perpendicular to the roller axis LA. The imaginary cylinder and/or imaginary at least partial cylinder may extend through and beyond the top imaginary plane and/or the bottom imaginary plane.

Induction coils 19.1, 19.2, 19.3 individually actuated in each case by an actuation or output level 23 form a heating device 19 and, with their outer surface, are adjacent to inner surface 12.2 of annular segment 12 but are spaced apart from this inner surface. Moreover, at least one temperature sensor 16.1, 16.2, 16.3 is assigned in induction coil 19.1, 19.2, 19.3, which sensor is located, in the embodiment shown, in each case at the same or approximately the same axial height with associated induction coil 19.1 or 19.3, i.e. is arranged such that respective temperature sensor 16.1, 16.2, 16.3 is arranged with its active region which measures the temperature approximately in the central plane, which perpendicularly, virtually perpendicularly, or substantially perpendicularly intersects gluing roller axis LA, of associated induction coil 19.1 or 19.3. In order to heat roller element 11 or annular segment 12, induction coils 19.1, 19.2, 19.3 are acted upon by actuation or output electronics 23, for example, in each case with an alternating current, e.g. with a fifty hertz alternating current, and namely to generate a magnetic alternating field and to induce eddy currents, in at least one possible embodiment of the present application, within annular segment 12, which then bring about the heating of this segment by electrical dissipation power. Adjacent induction coils 19.1 and 19.3 are in this case respectively actuated in the reverse direction by actuation or output electronics 23. The regulation or control, in at least one possible embodiment the temperature-dependent regulation or control of the currents through induction coil 19.1, 19.2, 19.3 is carried out, for example, by phase angle control.

In order to provide a sufficiently high magnetic flux for the magnetic alternating field, at least core 21 at least in its outer region is composed of a material with high magnetic conductivity. In order furthermore to induce eddy currents mainly in annular segment 12 as a result of the magnetic alternating field and minimize these in core 21, core 21 is formed by material selection and/or by corresponding structural configuration and/or structuring such that no or substantially no closed flow paths for eddy currents induced by the magnetic alternating field of induction coils 19.1, 19.2, 19.3 are produced in the core. Annular segment 12 on the contrary is composed of a material or a material combination which possesses a high magnetic conductivity and additionally also a high electrical conductivity to provide as high as possible a magnetic flux for the respective alternating field, and namely for inducing as high as possible eddy currents.

In at least one possible embodiment of the present application, the annular segment 12 may comprise a material that will induct heat from the induction coils 19.1, 19.2, and 19.3, such as cast iron or stainless steel. In other possible embodiments, other materials may be used, to comprise the annular segment 12.

As a result of the use of several individually actuable induction coils 19.1, 19.2, 19.3, it is, among other things, possible, for example, depending on the labels used and thus depending on the axial width which the glue application has on outer surface 12.1 of annular segment 12 in the direction of gluing roller axis LA, to heat circumferential surface 12.1 on a partial region by corresponding actuation of associated induction coil 19.1, 19.2, 19.3, for example, to save electrical energy, and/or provide as even as possible a temperature profile over the entire axial height of outer surface 12.1 by the individual actuation of induction coils 19.1, 19.2, 19.3, for example, by an increased output of both outer induction coils 19.1 and 19.3 and a correspondingly reduced output of central induction coil 19.2.

By inductive heating, gluing roller 10 is heated-up quickly and directly where heating is desired, namely on outer surface 12.1 of the annular segment without further components, such as, in at least one possible embodiment, bearings for shaft 14, being undesirably heated.

A heating of annular segment 12 is carried out on the entire circumference by induction coils 19.1, 19.2, 19.3. In at least one possible embodiment of the present application, the heating of the annular segment 12 may be carried out on at least a portion of the circumference of the annular segment 12 by at least one of the induction coils 19.1, 19.2, and 19.3.

Induction coils 19.1, 19.2, 19.3 and associated temperature sensors 16.1, 16.2, 16.3 thus form several separately regulatable heating zones. As a result of the division into several separate regulatable heating zones, an optimum adjustment of the temperature level or profile on outer surface 12.1 in the direction of gluing roller axis LA is possible.

As a result of the measurement of the temperature with temperature sensors 16.1, 16.2, 16.3 accommodated in annular segment 12, a temperature measurement with high precision is produced or may be possible.

All or substantially all of the elements which serve to heat gluing roller 10 or roller element 11 and for the temperature-dependent regulation or control are accommodated so that they are protected against contamination and mechanical damage, namely in the embodiment shown induction coils 19.1, 19.2, 19.3 in inner space 20 of roller element 11 and temperature sensors 16.1, 16.2, 16.3 in the at least one bore 15. In another possible embodiment of the present application, contamination and/or mechanical damage of the gluing roller 11 and/or rotating roller element 12 and/or temperature sensors 16 and/or induction coils 19 may be reduced or minimized.

None of the elements which serve for heating and/or temperature regulation or control is thus located within a region of gluing station 7 which is subjected to increased contamination.

The heating-up time of roller element 11 can be greatly reduced, for example in one possible embodiment of the present application, to a maximum of five minutes, while some gluing stations with heated gluing rollers have heating-up times of up to thirty to forty-five minutes.

In other possible embodiments of the present application, the heating-up time or warm-up time of the roller element 11 may be less than five minutes or greater than five minutes. The heat-up time of the roller element 11 may depend on the size of the roller element 11, the mass of the roller element 11, and/or the material comprising the roller element 11. The heat-up time of the roller element 11 may also depend on how many induction coils 19.1, 19.2, and 19.3 may be used to heat up zones of the roller element 11.

The availability of gluing station 7 or of the labeling assembly is thus significantly improved, substantially maximized, or promoted by the present application.

As a result of the fact that the heat output in the case of the gluing roller according to the present application is concentrated or substantially concentrated on the region actually to be heated, namely on annular segment 12 and its circumferential surface 12.1, there is furthermore also a noticeable reduction or a substantial reduction or sufficient reduction in the output utilized for heating and thus a significant energy saving. For example, the heat output of heatable gluing roller 10 can be reduced from the 1.2 kilowatts which was hitherto normal in the case of such gluing rollers to one-half kilowatt.

The present application was described above on the basis of at least one possible embodiment. It goes without saying that various changes and modifications are possible. It was thus assumed above that induction coils 19.1, 19.2, 19.3 are operated with alternating current. In principle, it is also possible to actuate induction coil 19.1, 19.2, 19.3 in the case of rotating roller element 11, i.e. during the ongoing operation of labeling assembly 4, with direct current. Actuation of induction coils 19.1, 19.2, 19.3 with alternating current is then carried out, for example, during a heating-up phase, i.e. in the case of roller element 11 not rotating or rotating at a low speed.

In order to improve, maximize, or promote the magnetic flux, it may also be desirable to enlarge the diameter of core 21 such that core 21 produced from a material with high magnetic conductivity extends with its circumferential surface close to inner surface 12.2 and a narrow magnet gap remains between core 21 and inner surface 12.2, as is indicated in FIG. 2 with intermittent lines 21.1. Core 21 is in this case formed on its circumferential surface with grooves in which induction coils 19.1, 19.2, 19.3 are then received so that a very low magnetic resistance is produced for the magnetic flux of the alternating field.

It was assumed above that induction coils 19.1, 19.2, 19.3 comprise in each case a winding which is configured rotation-symmetrically to gluing roller axis LA on core 21 and are arranged with their axis on the same axis as gluing roller axis LA. It is, however, also possible to arrange one or more induction coils, for example, comprising a plurality of individual windings or coils, within space 20 such that these induction coils are oriented with their axes radial to gluing roller axis LA. The non-rotating core which supports the induction coils or the individual windings thereof is then, for example, designed in accordance with the laminated core of the armature or rotor of an electromotor, and namely with grooves in which the winding forming the induction coil or the individual coils thereof is received.

In one possible embodiment of the present application, the gluing roller 10 may comprise the heating device or heating arrangement 19 disposed within the annular segment 12. The annular segment 12 may comprise an outer diameter 12.1 and an inner diameter 12.2. The heating arrangement 19 may be disposed within the outer surface or outer diameter 12.1.

In one possible embodiment of the present application, the temperature sensors 16 may be disposed between the outer diameter 12.1 and the inner diameter 12.2. The temperature sensors 16.1, 16.2, and 16.3 may be connected to the stator 17.2 and/or the measurement and control element or control device 18 by slip rings or other such devices or arrangements.

Figure 3:
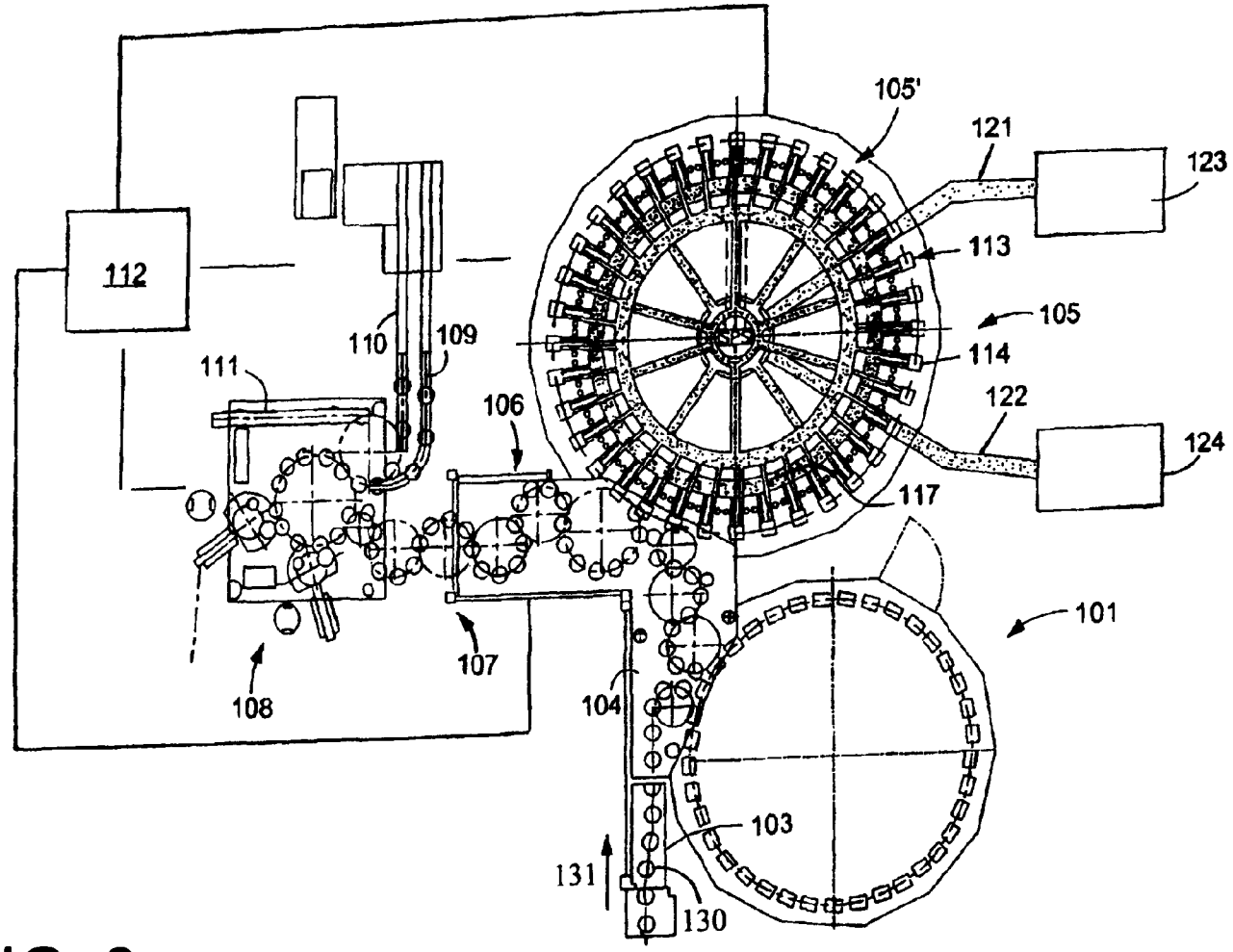
FIG. 3 shows schematically the main components of one possible embodiment example of a system for filling containers, for example a beverage bottling plant for filling bottles with at least one liquid beverage, in accordance with at least one possible embodiment, in which system or plant could possibly be utilized at least one aspect, or several aspects, of the embodiments disclosed herein.

FIG. 3 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 3 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 3, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

An electrically heatable gluing roller 10 for use with labeling machines, comprising a roller element 11 that can be driven to rotate about a gluing roller axis LA. The roller element forms at least one circumferential or gluing surface, which surrounds the gluing roller axis. The roller element is configured rotation-symmetrically to the roller axis LA for the application of glue to be transferred at least partially to labels. The gluing roller 10 also comprises a heating device 19 having at least one induction coil 19.1, 19.2, 19.3 for heating the roller element 11 at least on the glue surface 12.1 by currents induced in the roller element. The at least one heating device is completely accommodated in a space 20 that is located inside the gluing surface, or the imaginary extension thereof in the direction of the gluing roller axis.

One feature or aspect of an embodiment is believed at the time of the filing of this patent application to possibly reside broadly in a labeling assembly for labeling machines comprising at least one electrically heatable gluing roller, comprising a roller element that can be driven to rotate about a gluing roller axis. The roller element forms at least one circumferential or gluing surface, which surrounds the gluing roller axis and is configured rotation-symmetrically to the gluing roller axis, for the application of glue to be transferred at least partially to labels, comprising a heating device comprising at least one induction coil for heating the roller element at least on the glue surface by currents induced in the roller element, and comprising at least one temperature sensor for recording the temperature of the roller element on at least one region of the at least one glue surface, wherein the at least one heating device is completely, virtually completely, or substantially completely accommodated in a space that is located inside the gluing surface, or the imaginary extension thereof in the direction of the gluing roller axis, and that the at least one temperature sensor on the roller element is protected, in at least one possible embodiment of the present application, is accommodated in a manner which protects against contamination and/or mechanical damage. The present application also relates to, in at least one possible embodiment, a labeling assembly comprising an electrically heatable gluing roller.

Another feature or aspect of an embodiment is believed at the time of the filing of this patent application to possibly reside broadly in the labeling assembly, wherein the at least one heating device 19 has at least two induction coils 19.1, 19.2, 19.3, in one possible embodiment at least three induction coils 19.1, 19.2, 19.3, and that the induction coils 19.1, 19.2, 19.3 can be individually actuated.

Yet another feature or aspect of an embodiment is believed at the time of the filing of this patent application to possibly reside broadly in the labeling assembly, wherein each induction coil 19.1, 19.2, 19.3 is assigned in each case at least one temperature sensor 16.1, 16.2, 16.3.

Still another feature or aspect of an embodiment is believed at the time of the filing of this patent application to possibly reside broadly in the labeling assembly according to the present application, wherein the at least one heating device 19 is arranged in the inner space 20 of the roller element 11 which forms the gluing surface 12.1.

A further feature or aspect of an embodiment is believed at the time of the filing of this patent application to possibly reside broadly in the labeling assembly according to the present application, wherein the at least one gluing surface is a circular cylindrical surface 12.1 which concentrically surrounds the gluing roller axis LA.

Another feature or aspect of an embodiment is believed at the time of the filing of this patent application to possibly reside broadly in the labeling assembly according to the present application, wherein the space which receives the at least one heating device 19 or the at least one induction coil 19.1, 19.2, 19.3 has an inner surface 12.2 which concentrically surrounds the gluing roller axis LA and is configured rotation-symmetrically to the gluing roller axis LA, and that the heating device 19 or the at least one induction coil 19.1, 19.2, 19.3 is arranged adjacent to the inner surface 12.2.

Yet another feature or aspect of an embodiment is believed at the time of the filing of this patent application to possibly reside broadly in the labeling assembly, wherein the inner surface 12.2 is a circular cylindrical surface which concentrically surrounds the gluing roller axis LA.

Still another feature or aspect of an embodiment is believed at the time of the filing of this patent application to possibly reside broadly in the labeling assembly according to the present application, wherein the at least one heating device 19 or the at least one induction coil 19.1, 19.2, 19.3 is provided in a non-co-rotating manner with the roller element 11 which forms the at least one gluing surface 12.1.

A further feature or aspect of an embodiment is believed at the time of the filing of this patent application to possibly reside broadly in the labeling assembly according to the present application, wherein the at least one induction coil 19.1, 19.2, 19.3 is configured rotation-symmetrically or substantially rotation-symmetrically about a coil axis and is arranged with its coil axis on the same axis as the gluing roller axis LA.

Another feature or aspect of an embodiment is believed at the time of the filing of this patent application to possibly reside broadly in the labeling assembly, wherein, in the event of several heating devices 19 or induction coils 19.1, 19.2, 19.3, the heating devices 19 or induction coils 19.1, 19.2, 19.3 are provided offset in the direction of the gluing roller axis LA.

Yet another feature or aspect of an embodiment is believed at the time of the filing of this patent application to possibly reside broadly in the labeling assembly according the present application, wherein the at least one induction coil 19.1, 19.2, 19.3 is provided on a core 21.

One feature or aspect of an embodiment is believed at the time of the filing of this patent application to possibly reside broadly in the labeling assembly, wherein the core 21 at least in its region which is adjacent to the at least one induction coil 19.1, 19.2, 19.3 is composed of a material with high magnetic conductivity.

Another feature or aspect of an embodiment is believed at the time of the filing of this patent application to possibly reside broadly in the labeling assembly, wherein the core 21 is formed by material selection and/or by structural configuration and/or structuring such that a formation of eddy currents in the core 21 is at least largely minimized.

Yet another feature or aspect of an embodiment is believed at the time of the filing of this patent application to possibly reside broadly in the labeling assembly according to the present application, wherein the roller element 11 at the heated region is composed of a material or a material combination with a high electrical and/or high magnetic conductivity.

Still another feature or aspect of an embodiment is believed at the time of the filing of this patent application to possibly reside broadly in the labeling assembly according to the present application, comprising at least two temperature sensors 16.1, 16.2, 16.3 for determining the temperature at different regions of the at least one gluing surface 12.1.

A further feature or aspect of an embodiment is believed at the time of the filing of this patent application to possibly reside broadly in the labeling assembly according to the present application, wherein the at least one temperature sensor 16.1, 16.2, 16.3 provided on the roller element 11 is connected via a rotary transmitter, in at least one possible embodiment via a contact-free rotary transmitter, to measurement and control electronics 18.

Another feature or aspect of an embodiment is believed at the time of the filing of this patent application to possibly reside broadly in the labeling assembly according to the present application, wherein, in the event of several heating devices or induction coils 19.1, 19.2, 19.3, each heating device or each induction coil 19.1, 19.2, 19.3 is assigned in each case at least one temperature sensor 16.1, 16.2, 16.3.

Yet another feature or aspect of an embodiment is believed at the time of the filing of this patent application to possibly reside broadly in the labeling assembly according to the present application, wherein a carrier or core 21 reaches with the at least one heating element 19 or the at least one induction coil 19.1, 19.2, 19.3 from an open face of the roller element 11 into the inner space 20 formed by the roller element.

One feature or aspect of an embodiment is believed at the time of the filing of this patent application to possibly reside broadly in a beverage bottle filling plant for filling beverage bottles with liquid, said beverage bottle filling plant comprising: a beverage bottle filling machine being configured and disposed to fill beverage bottles with liquid; a first conveyor arrangement being configured and disposed to convey beverage bottles to be filled to said beverage bottle filling machine; said beverage bottle filling machine comprising: a rotor; a rotatable vertical machine column; said rotor being connected to said vertical machine column to permit rotation of said rotor about said vertical machine column; a plurality of beverage bottle filling elements for filling beverage bottles with liquid being disposed on the periphery of said rotor; each of said plurality of beverage bottle filling elements comprising a beverage bottle carrier being configured and disposed to receive and hold beverage bottles to be filled; each of said plurality of beverage bottle filling elements being configured and disposed to dispense liquid into beverage bottles to be filled; at least one liquid reservoir being configured to hold a supply of liquid; at least one supply line being configured and disposed to connect said at least one liquid reservoir to said beverage bottle filling machine to supply liquid to said beverage bottle filling machine; a first star wheel structure being configured and disposed to move beverage bottles into said beverage bottle filling machine; and a second star wheel structure being configured and disposed to move beverage bottles out of said beverage bottle filling machine; a beverage bottle closing machine being configured and disposed to close tops of filled beverage bottles; a second conveyor arrangement being configured and disposed to convey filled beverage bottles from said beverage bottle filling machine to said beverage bottle closing machine; said beverage bottle closing machine comprising: a rotor; a rotatable vertical machine column; said rotor being connected to said vertical machine column to permit rotation of said rotor about said vertical machine column; a plurality of closing devices being disposed on the periphery of said rotor; each of said plurality of closing devices being configured and disposed to place closures on filled beverage bottles; each of said plurality of closing devices comprising a beverage bottle carrier being configured and disposed to receive and hold filled beverage bottles; a first star wheel structure being configured and disposed to move filled beverage bottles into said beverage bottle closing machine; and a second star wheel structure being configured and disposed to move filled, closed beverage bottles out of said beverage bottle closing machine; a beverage bottle labeling machine being configured and disposed to label filled, closed beverage bottles; a third conveyor arrangement being configured and disposed to convey filled, closed beverage bottles from said beverage bottle closing machine; said beverage bottle labeling machine comprising: a rotor; a rotatable vertical machine column; said rotor being connected to said vertical machine column to permit rotation of said rotor about said vertical machine column; a plurality of container support structures being disposed on the periphery of said rotor; said container support structures being configured to support and hold filled, closed containers; a first star wheel structure being configured and disposed to move filled, closed containers into said container labeling machine; a second star wheel structure being configured and disposed to move filled, closed, labeled containers out of said container labeling machine; a supply of labels being configured and disposed to provide labels; a labeling roller being configured and disposed to: accept labels from said supply of labels; and apply labels to filled, closed beverage bottles in said beverage bottle labeling machine; a supply of glue being configured and disposed to provide glue; a gluing roller being configured and disposed to: accept glue from said supply of glue; and apply glue to labels on said labeling roller; said gluing roller comprising: a vertical axis around which said gluing roller is configured to rotate; an outer diameter comprising an outer diameter circumferential surface; an inner diameter comprising an inner diameter circumferential surface; said inner diameter circumferential surface being disposed within said outer diameter circumferential surface; a top annular surface; a bottom annular surface; a top imaginary plane extending along said top annular surface and extending perpendicular to said vertical axis; a bottom imaginary plane extending along said bottom annular surface and extending perpendicular to said vertical axis; a heating arrangement being configured and disposed to heat said outer diameter circumferential surface of said gluing roller; said heating arrangement comprising at least one induction coil; said at least one induction coil being disposed within said inner diameter circumferential surface and being disposed between said top imaginary plane containing said top annular surface and said bottom imaginary plane containing said bottom annular surface; at least one temperature sensor being disposed within said gluing roller and being configured to sense the temperature of said gluing roller on at least one region of said outer diameter circumferential surface; said at least one temperature sensor being disposed between said outer diameter and said inner diameter; and a sealing arrangement being configured and disposed to seal said at least one temperature sensor within said gluing roller to protect said at least one temperature sensor against contamination and mechanical damage.

Another feature or aspect of an embodiment is believed at the time of the filing of this patent application to possibly reside broadly in a gluing roller being configured to be disposed in a labeling machine and being configured to apply glue to labels; said gluing roller comprising: an axis around which said gluing roller is configured to rotate; an outer diametrical dimension comprising an outer surface; an inner diametrical dimension comprising an inner surface; said inner surface of said inner diametrical dimension being disposed within said outer surface of said outer diametrical dimension; a top surface substantially transverse to said outer surface and to said inner surface; a bottom surface substantially transverse to said outer surface and to said inner surface; a top imaginary plane extending along said top surface and extending perpendicular to said gluing roller axis; a bottom imaginary plane extending along said bottom surface and extending perpendicular to said gluing roller axis; an imaginary cylinder extending from said inner surface upwardly beyond said top surface and said top imaginary plane and extending from said inner surface downwardly beyond said bottom surface and said bottom imaginary plane; a heating arrangement being configured and disposed to heat said gluing roller; said heating arrangement comprising at least one induction coil; and said heating arrangement being disposed between said axis and at least one of: said inner surface and said imaginary cylinder.

Yet another feature or aspect of an embodiment is believed at the time of the filing of this patent application to possibly reside broadly in a gluing roller being configured to be disposed in a labeling machine and being configured to apply glue to labels; said gluing roller comprising: an axis around which said gluing roller is configured to rotate; an outer diametrical dimension comprising an outer surface; an inner diametrical dimension comprising an inner surface; said inner surface of said inner diametrical dimension being disposed within said outer surface of said outer diametrical dimension; at least one temperature sensor being disposed in said gluing roller and being configured to sense the temperature of said gluing roller on at least one region of said outer surface of said outer diametrical dimension; said at least one temperature sensor being disposed between said outer surface of said outer diametrical dimension and inner surface of said inner diametrical dimension; and a sealing arrangement being configured and disposed to seal said at least one temperature sensor within said gluing roller to protect said at least one temperature sensor against contamination and mechanical damage.

Still another feature or aspect of an embodiment is believed at the time of the filing of this patent application to possibly reside broadly in the gluing roller, wherein one of (i) and (ii): (i) said heating arrangement comprises at least two induction coils, which at least two induction coils are configured to be individually actuated; and (ii) said heating arrangement comprises at least three induction coils, which at least two induction coils are configured to be individually actuated.

A further feature or aspect of an embodiment is believed at the time of the filing of this patent application to possibly reside broadly in the gluing roller, wherein: said gluing roller comprises a heating arrangement being configured and disposed to heat said gluing roller; one of (a), (b), and (c): (a) said heating arrangement comprises at least one induction coil; (b) said heating arrangement comprises at least two induction coils, which at least two induction coils are configured to be individually actuated; and (c) said heating arrangement comprises at least three induction coils, which at least two induction coils are configured to be individually actuated.

Another feature or aspect of an embodiment is believed at the time of the filing of this patent application to possibly reside broadly in the gluing roller, wherein: said gluing roller comprises at least one temperature sensor; and each of said induction coils corresponds to at least one temperature sensor of said at least one temperature sensor.

Yet another feature or aspect of an embodiment is believed at the time of the filing of this patent application to possibly reside broadly in the gluing roller, wherein: said outer surface of said outer diametrical dimension comprises a gluing surface; and said gluing surface comprises a circular cylindrical surface configured to concentrically surround said gluing roller axis.

Still another feature or aspect of an embodiment is believed at the time of the filing of this patent application to possibly reside broadly in the gluing roller, wherein: said inner surface of said inner diametrical dimension is configured to concentrically surround said gluing roller axis; said inner surface of said inner diametrical dimension is disposed rotation-symmetrically to said gluing roller axis; and at least one of (iii) and (iv): (iii) said heating arrangement is disposed adjacent said inner surface of said inner diametrical dimension; and (iv) said at least one induction coil is disposed adjacent said inner surface of said inner diametrical dimension.

A further feature or aspect of an embodiment is believed at the time of the filing of this patent application to possibly reside broadly in the gluing roller, wherein: said inner surface of said inner diametrical dimension comprises a circular cylindrical surface; and said circular cylindrical surface is configured to concentrically surround said gluing roller axis.

Another feature or aspect of an embodiment is believed at the time of the filing of this patent application to possibly reside broadly in the gluing roller, wherein one of (v) and (vi): (v) said heating arrangement is disposed in a non-co-rotating manner with respect to said gluing roller and said gluing surface; and (vi) said at least one induction coil is disposed in a non-co-rotating manner with respect to said gluing roller and said gluing surface.

Yet another feature or aspect of an embodiment is believed at the time of the filing of this patent application to possibly reside broadly in the gluing roller, wherein: said at least one induction coil is disposed rotation-symmetrically or substantially rotation-symmetrically about a coil axis; and said coil axis is disposed coaxially to said gluing roller axis.

Still another feature or aspect of an embodiment is believed at the time of the filing of this patent application to possibly reside broadly in the gluing roller, wherein said at least one induction coil are disposed offset from one another in the direction of said gluing roller axis.

A further feature or aspect of an embodiment is believed at the time of the filing of this patent application to possibly reside broadly in the gluing roller, wherein: said gluing roller comprises a core; and said at least one induction coil is disposed on said core.

Another feature or aspect of an embodiment is believed at the time of the filing of this patent application to possibly reside broadly in the gluing roller, wherein at least a portion of said core comprises a material with high magnetic conductivity.

Yet another feature or aspect of an embodiment is believed at the time of the filing of this patent application to possibly reside broadly in the gluing roller, wherein said core is configured to minimize the formation of eddy currents in said core by at least one of: material selection, structural configuration, and structuring.

Still another feature or aspect of an embodiment is believed at the time of the filing of this patent application to possibly reside broadly in the gluing roller, wherein at least a portion of said gluing roller comprises a material or a material combination with a high electrical and/or high magnetic conductivity.

A further feature or aspect of an embodiment is believed at the time of the filing of this patent application to possibly reside broadly in the gluing roller, wherein said at least one temperature sensor comprises at least two temperature sensors configured to sense the temperature at different regions of said gluing surface.

One feature or aspect of an embodiment is believed at the time of the filing of this patent application to possibly reside broadly in the gluing roller, wherein: said gluing roller comprises measurement and control electronics; said gluing roller comprises a rotary transmitter; said at least two temperature sensors are connected to said measurement and control electronics by said rotary transmitter; and said rotary transmitter comprises a contact-free rotary transmitter.

Another feature or aspect of an embodiment is believed at the time of the filing of this patent application to possibly reside broadly in the gluing roller, wherein one of (vii) and (viii): (vii) said core reaches with said heating arrangement from an open face of said gluing roller into the space between said top imaginary plane and said bottom imaginary plane and in said inner surface; and (viii) said core reaches with said at least one induction coil from an open face of said gluing roller into the space between said top imaginary plane and said bottom imaginary plane and in said inner surface.

Yet another feature or aspect of an embodiment is believed at the time of the filing of this patent application to possibly reside broadly in the gluing roller, wherein said gluing roller comprises: a top surface substantially transverse to said outer surface and to said inner surface; a bottom surface substantially transverse to said outer surface and to said inner surface; a top imaginary plane extending along said top surface and extending perpendicular to said gluing roller axis; a bottom imaginary plane extending along said bottom surface and extending perpendicular to said gluing roller axis; an imaginary cylinder extending from said inner surface upwardly beyond said top surface and said top imaginary plane and extending from said inner surface downwardly beyond said bottom surface and said bottom imaginary plane; one of (vii) and (viii): (vii) said core reaches with said heating arrangement from an open face of said gluing roller into the space between said top imaginary plane and said bottom imaginary plane and in said inner surface; and (viii) said core reaches with said at least two induction coils from an open face of said gluing roller into the space between said top imaginary plane and said bottom imaginary plane and in said inner surface.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, except for the exceptions indicated herein, which were cited in the International Search Report dated Oct. 2, 2009 and/or cited elsewhere are hereby incorporated by reference as if set forth in their entirety herein, as follows: DE 298 22 906 U1, having the following German title "Leimauftragsvorrichtung für Etikettiermaschinen," published on Feb. 3, 2000; DE 202 17 966 U1, having the following German title "Induktionsbeheizte Kalanderwalze," published on Apr. 1, 2004; U.S. Pat. No. 5,362,945 A, having the title "GODET FOR HEATING AN ADVANCING YARN," published on Nov. 8, 1994; and EP 1 416 772 A, having the following German title "Induktiv beheizte Galette," published on May 6, 2004.

All of the patents, patent applications or patent publications, except for the exceptions indicated herein, which were cited in the German Office Action dated Jun. 6, 2008 and/or cited elsewhere are hereby incorporated by reference as if set forth in their entirety herein, as follows: JP 2002-170659 A, having the translated English title "INDUCTION HEATING ROLLER DEVICE," published on Jun. 14, 2002; U.S. Pat. No. 3,790,736 A, having the title "HEATING ROLLERS," published on Feb. 5, 1974; DE 37 41 232 C2, having the following German title "Vorrichtung zum Einfärben von geprägten Schildern, insbesondere Kraftfahrzeug-Kennzeichenschildern," published on Oct. 1, 1992; EP 1 168 889 A2, having the title "Induction-heating roller device," published on Jan. 1, 2002; JP 2004-094076 A, having the translated English title "FIXING DEVICE AND IMAGE FORMING APPARATUS," published on Mar. 25, 2004; and US 2006/0276317 A1, having the title "THERMO ROLL," published on Dec. 7, 2006.

Some examples of seal arrangements that may possibly be utilized or possibly adapted for use in at least one possible embodiment of the present application may possibly be found in the following U.S. Pat. No. 5,411,273 issued to Pietsch et al. on May 2, 1995; U.S. Pat. No. 6,290,234 issued to Berle et al. on Sep. 18, 2001; U.S. Pat. No. 6,474,653 issued to Hintenlang et al. on Nov. 5, 2002; U.S. Pat. No. 6,616,146 issued to Friend et al. on Sep. 9, 2003; U.S. Pat. No. 6,692,007 issued to Oldenburg on Feb. 17, 2004; and U.S. Pat. No. 6,648,335 issued to Ezell on Nov. 18, 2003.

Some examples of labeling machines which may possibly be utilized in at least one possible embodiment may possibly be found in the following U.S. Pat. No. 6,634,400, entitled "Labeling machine"; U.S. Pat. No. 6,561,246, entitled "Labeling machine capable of precise attachment of a label to different sizes of containers"; U.S. Pat. No. 6,550,512, entitled "Labeling machine capable of preventing erroneous attachment of labels on containers"; U.S. Pat. No. 6,543,514, entitled "In-line continuous feed sleeve labeling machine and method"; U.S. Pat. No. 6,378,587, entitled "Cylindrical container labeling machine"; U.S. Pat. No. 6,328,086, entitled "Labeling machine"; U.S. Pat. No. 6,315,021, entitled "Labeling machine"; U.S. Pat. No. 6,263,940, entitled "In-line continuous feed sleeve labeling machine and method"; U.S. Pat. No. 6,199,614, entitled "High speed labeling machine having a constant tension driving system"; U.S. Pat. No. 6,167,935, entitled "Labeling machine"; U.S. Pat. No. 6,066,223, entitled "Labeling machine and method"; U.S. Pat. No. 6,050,319, entitled "Non-round container labeling machine and method"; and U.S. Pat. No. 6,045,616, entitled "Adhesive station and labeling machine."

Some examples of arrangements and/or methods of induction heating, which may possibly be utilized or adapted for use in at least one possible embodiment of the present application, may possibly be found in the following U.S. Pat. No. 7,696,458, having the title "Induction heating system and method of output power control," published on Apr. 13, 2010; U.S. Pat. No. 7,688,601, having the title "Method and arrangement for the power supply of an induction heating device," published on Mar. 30, 2010; U.S. Pat. No. 7,590,377, having the title "Fixing device and image forming apparatus with nonmagnetic metal layer substantially free from temperature rise due to induction heating," published on Sep. 15, 2010; U.S. Pat. No. 7,582,851, having the title "Gradient induction heating of a workpiece," published on Sep. 1, 2009; U.S. Pat. No. 7,542,313, having the title "Induction heating apparatus capable of stably operating at least one switching element contained therein," published on Jun. 2, 2009; and U.S. Pat. No. 7,432,481, having the title "Induction heating method and unit," published on Oct. 7, 2008.

Some examples of slip rings or arrangements utilizing slip rings or methods of using slip rings, which may possibly be utilized or adapted for use in at least one possible embodiment of the present application, may possibly be found in the following U.S. Pat. No. 5,865,629, having the title "Pick-up elements for slip rings or rotary connectors," published on Feb. 2, 1999; U.S. Pat. No. 7,417,353, having the title "On-vehicle alternator with brush/slip ring structure," published on Aug. 26, 2008; U.S. Pat. No. 7,358,642, having the title "Dynamoelectric rotor," published on Apr. 15, 2008; U.S. Pat. No. 7,358,641, having the title "Brush device for rotary electric machine," published on Apr. 15, 2008; U.S. Pat. No. 6,861,779, having the title "Slip ring brush assembly and method," published on Mar. 1, 2005; U.S. Pat. No. 7,607,476, having the title "Expandable slip ring," published on Oct. 27, 2009; and U.S. Pat. No. 7,495,366, having the title "Compact slip ring incorporating fiber-on-tips contact technology," published on Feb. 24, 2009. An alternative to a slip ring, which may possibly be utilized or adapted for use in at least one possible embodiment of the present application, may possibly be found in U.S. Pat. No. 7,667,769, having the title "Rotatable wireless electrical coupler," published on Feb. 23, 2010.

The patents, patent applications, and patent publications listed above in the preceding paragraphs are herein incorporated by reference as if set forth in their entirety except for the exceptions indicated herein. The purpose of incorporating U.S. patents, Foreign patents, publications, etc. is solely to provide additional information relating to technical features of one or more embodiments, which information may not be completely disclosed in the wording in the pages of this application. However, words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments of the patents, patent applications, and patent publications, are not considered to be incorporated by reference herein.

The corresponding foreign and international patent publication applications, namely, Federal Republic of Germany Patent Application No. 10 2007 054 147.5, filed on Nov. 12, 2007, having inventor Klaus KRÄMER, and DE-OS 10 2007 054 147.5 and DE-PS 10 2007 054 147.5, and International Application No. PCT/EP2008/009427, filed on Nov. 7, 2008, having WIPO Publication No. WO2009/062640 A1 and inventor Klaus KRÄMER, are hereby incorporated by reference as if set forth in their entirety herein, except for the exceptions indicated herein, for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, except for the exceptions indicated herein, are hereby incorporated by reference as if set forth in their entirety herein.

The purpose of incorporating the corresponding foreign equivalent patent applications, that is, PCT/EP2008/009427 and German Patent Application DE 10 2007 054 147.5, is solely for the purpose of providing a basis of correction of any wording in the pages of the present application, which may have been mistranslated or misinterpreted by the translator. However, words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments of the patents, patent applications, and patent publications, are not generally considered to be incorporated by reference herein.

Statements made in the original foreign patent applications PCT/EP2008/009427 and DE 10 2007 054 147.5 from which this patent application claims priority which do not have to do with the correction of the translation in this patent application are not to be included in this patent application in the incorporation by reference.

Any statements about admissions of prior art in the original foreign patent applications PCT/EP2008/009427 and DE 10 2007 054 147.5 are not to be included in this patent application in the incorporation by reference, since the laws relating to prior art in non-U.S. Patent Offices and courts may be substantially different from the Patent Laws of the United States.

All of the references and documents cited in any of the documents cited herein, except for the exceptions indicated herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Labeling machine
2 Bottle
3 Rotor
4 Labeling assembly
5 Pallet carrier
6 Label pallet
7 Gluing station
8 Label magazine
9 Gripper cylinder

10 Gluing roller
10.1 Gluing strip
11 Rotating roller element
12 Annular segment
12.1 Outer surface of the annular segment and thus of roller element 11
12.2 Inner surface of the annular segment
13 Base segment
14 Shaft
15 Bore
16.1, 16.2, 16.3 Temperature sensor
17 Electrical rotary transmitter
17.1 Rotor of rotary transmitter 17
17.2 Stator of rotary transmitter 17
18 Measurement and control electronics
19 Heating device
19.1, 19.2, 19.3 Induction coil
20 Inner space of roller element 11
21 Core
22 Carrier or bracket
23 Actuation or output electronics
LA Gluing roller axis

What is claimed is:

1. A gluing arrangement for applying glue to labels in a labeling machine, said gluing arrangement comprising:
a glue supply containing glue;
a roller element being cylindrically-shaped and disposed to receive glue from said glue supply, and to provide said glue to be transferred to labels;
a machine frame;
said roller element being rotatably mounted on said machine frame to rotate about a rotational axis oriented vertically;
an induction heating arrangement being disposed within said roller element to heat said roller element;
a temperature sensor arrangement being disposed and configured to sense the temperature of at least a portion of said roller element;
said temperature sensor arrangement being protectively sealed against contamination and mechanical damage;
said machine frame comprising a stationary support;
said induction heating arrangement being suspended from above on said stationary support;
said roller element comprising an annular body disposed around said induction heating arrangement, and a drive shaft disposed beneath said induction heating arrangement;
said drive shaft being connected to a bottom portion of said annular body; and
said machine frame comprising a drive unit connected to said drive shaft to rotate said drive shaft and thus said annular body about said induction heating arrangement and said vertical rotational axis.

2. The gluing arrangement according to claim 1, wherein:
said annular body comprises a circular cylindrical outer surface and an inner portion disposed within said outer surface;
said inner portion of said annular body comprises an inner surface; and
said temperature sensor arrangement comprises temperature sensors disposed at intervals inside said annular body between said inner and outer surfaces, and configured to sense the temperature of at least a portion of said outer surface.

3. The gluing arrangement according to claim 2, wherein:
said induction heating arrangement comprises a first induction heater and a second induction heater disposed within and surrounded by said inner portion of said annular body;
said temperature sensors comprise a first temperature sensor and a second temperature sensor;
said first temperature sensor is disposed essentially at the center of said first induction heater; and
said second temperature sensor is disposed essentially at the center of said second induction heater.

4. The gluing arrangement according to claim 3, wherein:
said induction heating arrangement comprises a core that comprises a material with high magnetic conductivity;
said core comprises a diameter slightly less than an inner diameter of said annular body, such that there is a narrow gap between an outer surface of said core and said inner surface of said annular body.

5. The gluing arrangement according to claim 4, wherein each of said induction heaters comprises a plurality of layers of induction coils, of which the innermost layer is coiled around said core and each subsequent layer, in the radial direction from the vertical rotational axis, is coiled around a preceding layer.

6. The gluing arrangement according to claim 5, wherein said core is configured to minimize the formation of eddy currents in said core by at least one of: material selection, structural configuration, and structuring, and at least a portion of said roller element which is to be heated comprises a material or a material combination with a high electrical and/or high magnetic conductivity.

7. The gluing arrangement according to claim 6, wherein:
said roller element comprises measurement and control electronics;
said roller element comprises a contact-free rotary transmitter; and
said temperature sensors are connected to said measurement and control electronics by said rotary transmitter.

8. The gluing arrangement according to claim 7, wherein said temperature sensors are disposed inside an elongated vertical bore in said annular body.

9. The gluing arrangement according to claim 2, wherein:
said induction heating arrangement comprises a first induction heater and a second induction heater disposed within and surrounded by said inner portion of said annular body;
said temperature sensors comprise solely three temperature sensors: a first temperature sensor, a second temperature sensor, and a third temperature sensor;
said first temperature sensor is disposed essentially at the center of said first induction heater;
said second temperature sensor is disposed essentially at the center of said second induction heater; and
said third temperature sensor is disposed essentially at the center of said third induction heater.

10. The gluing arrangement according to claim 2, wherein:
said induction heating arrangement comprises a core that comprises a material with high magnetic conductivity;
said core comprises a diameter slightly less than an inner diameter of said annular body, such that there is a narrow gap between an outer surface of said core and said inner surface of said annular body.

11. The gluing arrangement according to claim 10, wherein each of said induction heaters comprises a plurality of layers of induction coils, of which the innermost layer is coiled around said core and each subsequent layer, in the radial direction from the vertical rotational axis, is coiled around a preceding layer.

12. The gluing arrangement according to claim 2, wherein said temperature sensors are disposed inside an elongated vertical bore in said annular body.

13. The gluing arrangement according to claim 1, wherein:

said induction heating arrangement comprises a core that comprises a material with high magnetic conductivity;

said core is configured to minimize the formation of eddy currents in said core by at least one of: material selection, structural configuration, and structuring, and at least a portion of said roller element which is to be heated comprises a material or a material combination with a high electrical and/or high magnetic conductivity;

said roller element comprises measurement and control electronics;

said roller element comprises a contact-free rotary transmitter; and said temperature sensor arrangement comprises at least two temperature sensors connected to said measurement and control electronics by said rotary transmitter.

* * * * *